United States Patent [19]

Larime

[11] 4,153,898

[45] May 8, 1979

[54] AUDIBLE ALARM WITH LAMINATED MAGNETIC CORE

[75] Inventor: Carl M. Larime, Fairfield, Conn.

[73] Assignee: General Signal Corporation, Rochester, N.Y.

[21] Appl. No.: 868,155

[22] Filed: Jan. 9, 1978

Related U.S. Application Data

[63] Continuation of Ser. No. 720,879, Sep. 7, 1976, abandoned.

[51] Int. Cl.[2] ..... G08B 3/00

[52] U.S. Cl. ..... 340/396; 340/392; 340/402; 340/403

[58] Field of Search ..... 340/392, 396, 402, 403

[56] References Cited

U.S. PATENT DOCUMENTS 3,550,118 12/1970 Jenkins ..... 340/396

*Primary Examiner*—Harold I. Pitts

*Attorney, Agent, or Firm*—Milton E. Kleinman; George W. Killian

[57] ABSTRACT

An electrically actuated audible alarm having a magnetic structure comprising an assembly of laminations is provided to reduce eddy current losses. With the reduction of eddy current losses, faster magnetic flux buildup is possible and an increased velocity of striker and/or armature movement. The increased striker velocity permits delivery of a given quantum of energy to the gong with a reduced striker mass which in turn facilitates even greater velocity. When actuated from an a.c. current source, a diode may be used in series with the winding to interrupt magnetic flux generation on negative half cycles and permit return movement of armature and striker. Conventional interrupter contacts may be used when actuated from a d.c. source. A series diode provides for d.c. loop supervision. A multiple lead permits the audible alarm to comprise part of the loop circuit and thereby provide a supervisory signal if an audible alarm is missing.

7 Claims, 9 Drawing Figures

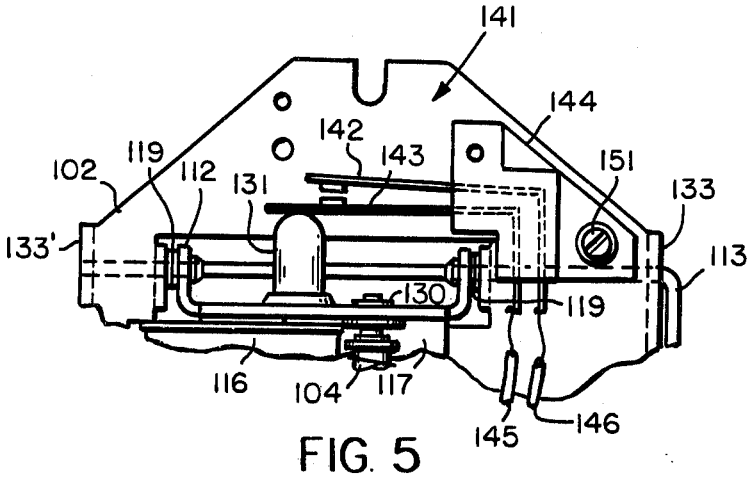
FIG. 5
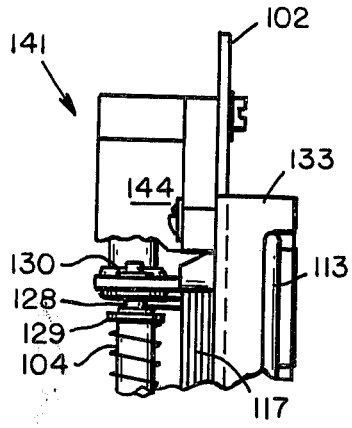
FIG. 6
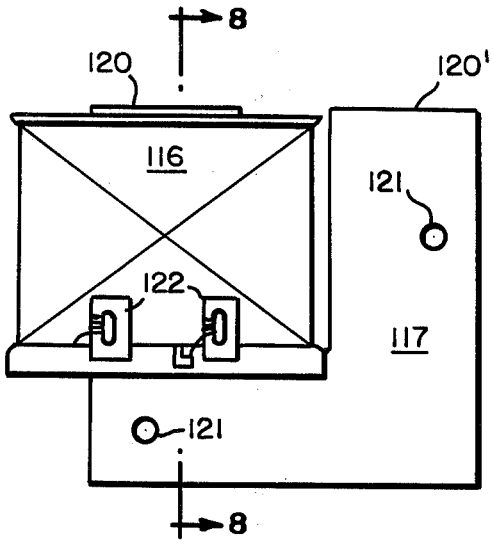
FIG. 7
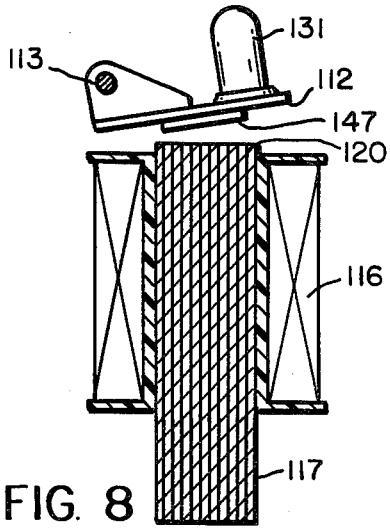
FIG. 8
FIG. 9
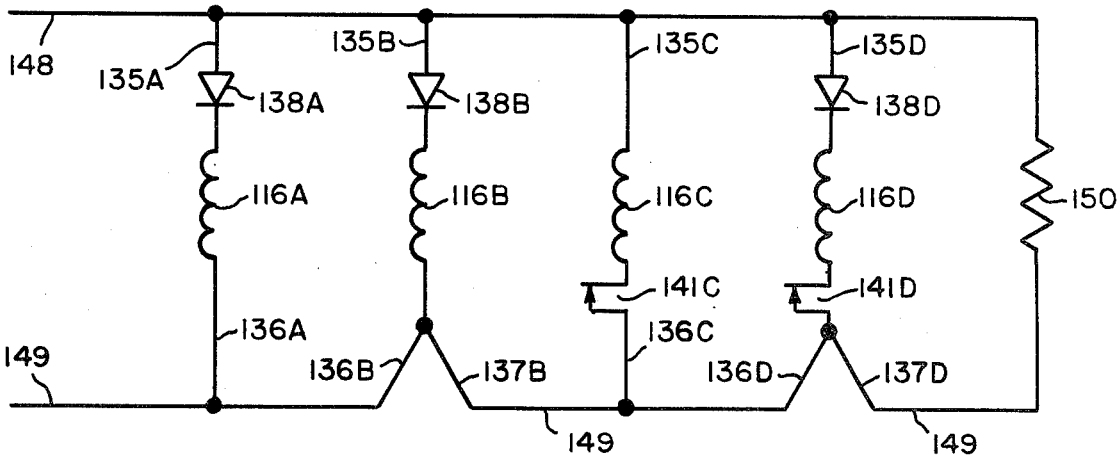

AUDIBLE ALARM WITH LAMINATED MAGNETIC CORE

REFERENCE TO RELATED APPLICATION

This is a continuation of Application Ser. No. 720,879, filed Sept. 7, 1976, now abandoned.

BACKGROUND OF THE INVENTION

1. Field of the Invention

This invention relates to audible alarms, bells or gongs of the type which employ a reciprocating striker for repetitively striking a gong member. Such devices have been widely used in diverse applications such as: fire alarm systems; school systems for indicating the beginning and/or ending of time intervals; and code systems wherein the gong is struck a controlled period of time at controlled intervals for code generation.

2. Description of the Prior Art

Devices of the general class described usually employ a magnetic structure including a winding wound on a ferromagnetic core for producing a magnetic flux for actuating a reciprocating striker mechanism. In direct current actuated systems, power may be turned off and on to actuate each strike, or interrupter contacts may be built into the mechanism for self-interrupt actuation. Systems actuated from a.c. power sources have required either rectification or the use of permanent magnets to allow the striker mechanism to release during the negative half cycle of the a.c. power.

In devices of the class described, it is often desirable to obtain a maximum sound output for the input energy provided. Various factors control the sound output level. These factors include the mass of the striker structure and its velocity at the time it strikes the gong. Since the energy of the striker may be computed as $\frac{1}{2}mv^2$ the energy may be increased by increasing either the mass or the velocity of the striker. Prior art systems have provided increased sound by using strikers of increased mass and/or have attempted to increase the velocity of the striker by providing larger coils with more turns more intimately associated with the magnetic circuit for inducing more magnetic flux.

SUMMARY OF THE INVENTION

The present invention provides an audible alarm with a gong which, in relation to its size, weight, and input energy consumption, produces a greater sound output level than prior art devices. Sound outputs of nearly 100 DB at ten feet with an input of under 2VA are obtained. Prior art devices capable of producing similar sound output required from about three to ten times as much power input. The improved operating characteristics are obtained by providing a structure in which the moving parts have a minimum mass and an improved magnetic circuit with significantly reduced eddy currents which are counter productive. The mass reduction and improved magnetic circuit provides a system which materially increases the velocity of the striker. With a materially increased striker velocity, the mass may be reduced without reducing the total energy with which the striker strikes the gong. Since the energy imparted to the gong is a function of the mass of the striker times the velocity squared, an increase in velocity will have a greater effect than an increase in mass, or phrased differently, an increased velocity will permit a mass reduction. The mass reduction reduces the inertia of the striker, thereby permitting improved acceleration and an even greater velocity. The gong struck by the striker may have any suitable configuration.

The improved magnetic circuit is provided by using a laminated core structure instead of the traditional solid ferromagnetic core. The use of the laminated core greatly reduces the deletrious eddy currents which delay magnetic flux generation.

An embodiment of the invention designed for actuation from a 60 Hz commercial power supply employs a diode in series with the coil winding. The diode blocks the negative half cycles of the input power and, thereby, provides time for magnetic decay and return of the low mass armature and striker assembly. This technique permits the elimination of permanent magnets which were used in some prior art devices. Devices designed for 60 Hz a.c. operation should be designed to have a natural frequency of operation of not less than 60 cycles. Without the diode, the current and magnetic flux would reverse, but there would be insufficient time for mechanical release of the striker mechanism. Although laminated cores are generally more expensive than solid cores, the present structure permits a device that is appreciably smaller, lighter, faster acting and more economical than prior art devices capable of producing the same sound output level.

It is an object of the invention to provide a new and improved electromagnetically actuated audible alarm.

It is a more specific object of the invention to provide a new and improved electromagnetically actuated audible alarm which is more efficient in operation in that it produces a maximum sound output level for the input energy.

It is another object of the invention to provide a magnetic circuit which has reduced magnetic losses.

It is another object of the invention to provide an armature and striker mechanism which is lighter in weight and, therefore, may be more readily accelerated to higher velocities.

It is another object of this invention to provide a laminated magnetic structure for reducing eddy current losses.

It is another object of this invention to provide an electromagnetically actuated audible alarm which may be actuated from either a.c. or d.c. potential sources.

It is another object of this invention to provide loop supervision with plural audible alarms bridged across the loop.

It is another object of the invention to provide a supervisory signal indicative of a missing audible alarm.

BRIEF DESCRIPTION OF THE DRAWING

In the accompanying figures, like elements are always identified with like reference numerals. The principal objects and advantages of the structure will be more fully understood when the specification is considered together with the drawing in which:

FIG. 5 is a partial view of a structure similar to FIG. 3, but showing the differences for a direct current assembly;

FIG. 6 is a side view of the structure shown in FIG. 5;

FIG. 7 is a sub-assembly showing the coil and laminated magnetic core structure;

FIG. 8 is an enlarged cross section view of FIG. 7 taken on line 8—8 and showing other selected elements; and FIG. 9 is a wiring diagram of various a.c. and d.c. models of the structure.

DESCRIPTION OF THE PREFERRED EMBODIMENTS

Figure 1:
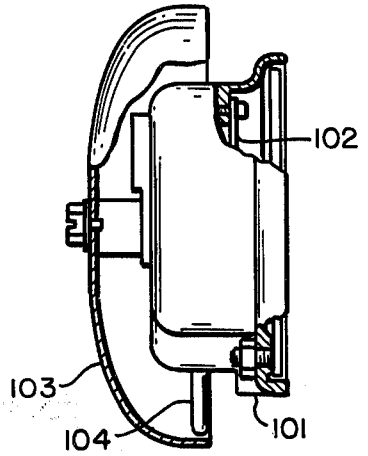
FIG. 1 constitutes a side view, partially in cross section, illustrating a complete unit.

Considering now more specifically FIG. 1, there is seen a side view, partially in cross section, illustrating a typical audible alarm assembly made in accordance with the present invention and which is also typical, so far as may be seen in this view, of prior art devices. The structure includes a bell base 101, a coil bracket assembly 102, a gong 103, a striker 104 and a variety of other parts including various assembly screws etc. not specifically designated. When the device is electrically energized, it will be shown that the striker 104 vibrates in a longitudinally reciprocal manner and strikes the gong 103 to generate a sound. The gong 103 is appropriately mounted to facilitate sound generation and dispersion.

Figure 2:
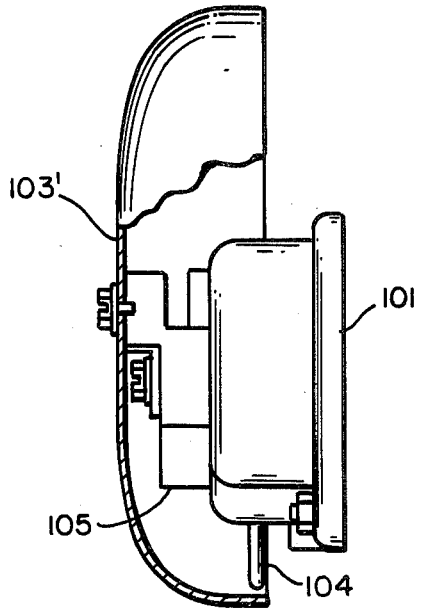
FIG. 2 is a structure similar to that shown in FIG. 1 but employs a larger gong.

As will be seen, FIG. 2 discloses an audible alarm similar to that shown in FIG. 1, but employs a larger gong 103' which is mounted in an offset manner by mounting block 105 so that the edge of the gong 103' is at an appropriate distance from the striker 104. This allows given actuating assembly (see FIG. 3) to work with various size gongs 103 or 103'. Gongs of other size and/or configuration could be used if desired. The size of gong 103, or 103' that is used depends upon a variety of factors which do not have a direct relation to the invention disclosed herein. It will suffice to say that for a specific gong 103, the sound intensity may be increased by causing the striker 104 to strike the gong with an increased velocity or to increase the mass of the striker 104 and strike the gong 103 with the same velocity. The present invention relates to techniques for moving the striker 104 in a manner that will provide maximum sound output from the particular gong with which it is associated and in view of the magnitude of the energy input.

Figure 3:
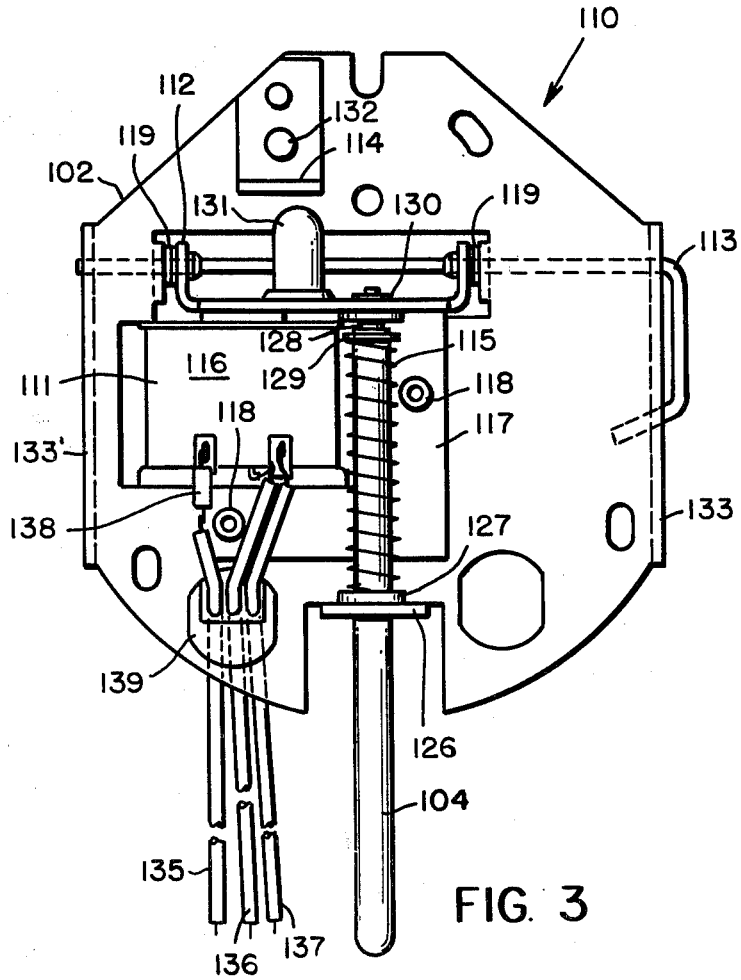
FIG. 3 is a front view of the actuating assembly for an a.c. structure shown energized.

Considering now more specifically FIG. 3, there will be seen the actuating assembly for the structures shown in FIGS. 1 and 2. This particular actuating assembly is for an a.c. actuated device. Another figure will disclose the modifications which may be made to adapt the actuating assembly for use with a d.c. power supply. The actuating assembly 110 includes the striker 104 and the coil bracket assembly 102 shown in FIG. 1. In addition, there may be seen a magnet assembly 111, an armature assembly 112, a hinge pin 113, a back stop 114, and a compression spring 115. The magnet assembly 111 includes the coil 116 and the magnetic structure 117. As will be shown more fully hereinafter, the magnetic structure 117 comprises a plurality of ferromagnetic members assembled in laminated fashion and held to the coil bracket assembly 102 by rivets or eyelets 118 or any other suitable and convenient means. As is conventional with magnet assemblies 111, the magnetic structure 117 is generally C-shaped and includes a leg around which the coil 116 is wound. The leg around which coil 116 is wound is obscured in FIG. 3, but will be shown more fully hereinafter in FIGS. 7 and 8.

The armature assembly 112 is pivotally coupled on the hinge pin 113 with bearings 119. The armature assembly 112 is shown in the actuated position. That is, it is drawn in position with the armature assembly 112 closest to the magnet assembly 111 and with the striker 104 in a downward position.

The striker 104 is partially supported by a bent up tab member 126 of the coil bracket assembly 102. A bearing 127 is retained by the tab member 126 and supports the striker 104. Near the upper end 128 of the striker 104, there is an undercut section in which retainer ring 129 is engaged. Upward on the striker 104 from the retainer ring 129, a portion of the striker 104 passes through bearing 130 retained in the armature assembly 112. The compression spring 115 surrounding the striker 104 bears against the bearing 127 and the retainer ring 129 and urges the striker 104 in an upward direction as viewed in FIG. 3. Thus, the compression spring 115 applies a force to the armature assembly 112 to urge it away from the coil 116 and the magnetic structure 117. When the armature assembly 112 is attracted to the magnetic structure 117 by energization of the coil 116, the compression spring 115 is compressed slightly. In response to each attraction of the armature assembly 112 to the magnetic structure 117, the striker 104 is driven downward, as viewed in FIGS. 3 and 4, to strike the gong 103 or 103' as shown in FIGS. 1 and 2, respectively. In actual practice, the armature assembly 112 may move with sufficient velocity to accelerate the striker 104 and cause the striker 104 to continue a downward motion subsequent to the time that the armature assembly 112 strikes the magnetic structure 117. Such actuation of a striker mechanism is standard in devices of this class.

The backward motion of the armature assembly 112 away from the magnetic structure 117 is limited by the stop member 131 which is coupled to the armature assembly 112 and strikes the backstop 114 when the coil 116 is de-energized. The maximum travel of the armature assembly 112 is controlled by the adjustment of the backstop 114 and the gap between it and the stop member 131 when the coil 116 is energized and the armature assembly 112 is in contact with the magnetic structure 117.

Figure 4:
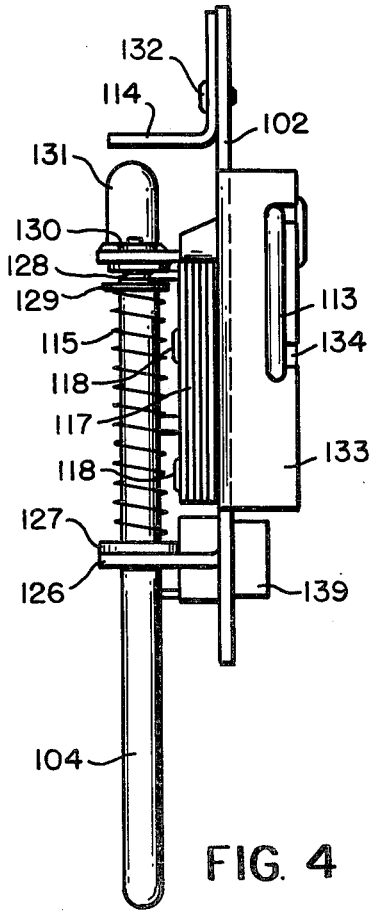
FIG. 4 is a side view of the structure of FIG. 3 as viewed from the right.

As may be more easily seen in FIG. 4, the backstop 114 is supported on the coil bracket assembly 102 by a fastener means 132 which may comprise a rivet or any other convenient fastening means. Also, as will be seen, the coil bracket assembly 102 includes bent tabs 133 and 133' having holes for supporting the hinge pin 113. As may be visualized by examining FIGS. 3 and 4, the hinge pin 113 may be removed by grasping the end seen in FIG. 4 and releasing it from the slot 134 and then extracting the hinge pin 113. This will release the armature assembly 112. The striker 104 is coupled to the armature 112 as close as practical to the hinge pin 113 to minimize system inertia.

Coupled to the coil 116 (FIG. 3) are wires 135, 136 and 137 and it will be seen that wire 135 is coupled to one end of a diode 138, the other end of which is coupled to the coil 116. As will be more fully explained in connection with FIG. 9, the diode 138 is optional and the use of the two wires 136 and 137, rather than a single wire, is also optional. The wires 135 through 137 are retained and restrained by the conventional strain relief device 139.

FIG. 5 is similar to the upper portion of FIG. 3 and corresponding parts are appropriately designated. In addition to these parts, there is shown a pair of interrupter contacts and support structure indicated generally as 141. It will also be observed that in FIG. 5, which constitutes a d.c. version of the device, the backstop 114 has been omitted. In this structure, the stop member 131 actuates the interrupter contacts 141 to open and close the individual contacts 142 and 143. When the armature assembly 112 is attracted to the magnetic structure 117, as illustrated, the contact springs 142 and 143 will be separated and when the armature assembly 12 is in its at rest position, it will pivot on the hinge pin 113 and close the contact springs 142 and 143. The contact springs 142 and 143 are supported by the contact block assembly 144 and connection made thereto through the wires 145 and 146. The circuit connecting the interrupter contacts 141 with the coil 116 will be shown more fully hereinafter in connection with the diagrams of FIG. 9. The contact block assembly 144 may be affixed to the coil bracket assembly 102 in any convenient manner such as screw 151. As is conventional with interrupter contacts 142 and 143, the point at which they make and/or break relative to the position of the armature assembly 112 may be adjusted by appropriate formation of the contact springs 142 and 143. As is well known to those familiar with this art, if the contact springs 142 and 143 separate too early, the device may fail to function and if the contact springs 142 and 143 fail to open, repetitive actuation will not be attained.

FIG. 6 shows a side view of FIG. 5 with the parts appropriately designated. In this side view, the contact springs 142 and 143 are hidden from view by the contact block assembly 144.

FIG. 7 shows a sub-assembly including the coil 116 and the magnetic structure 117. As previously mentioned, the magnetic structure 117 comprises a plurality of laminated ferromagnetic elements. Each lamination is "C" shaped with the coil 116 wound on one leg. The laminations provide pole faces 120 and 120' against which the armature assembly 112 (not shown in FIG. 7) strikes. The armature assembly 12 completes the magnetic circuit. As shown in FIG. 3, eyelets 118 are used to secure the magnetic structure 117 to the coil bracket assembly 102. Holes 121 are provided for these eyelets or rivets 118. The ends of the wire comprising the coil 16 are attached to the terminals 122.

Considering now more specifically FIG. 8, there is shown therein a cross sectional view of FIG. 7 taken along the line 8—8 and including the armature assembly 112. As may be seen in FIG. 8, the armature assembly 112 includes a residual shim 147 which is made of nonmagnetic material. The residual shim 147 prevents direct metallic contact between the ferromagnetic armature assembly 112 and the pole faces 120 and 120' of magnetic structure 117. As those familiar with the art will recognize, direct contact between the armature assembly 112 and the pole face 120 of the magnetic structure 117 could result in residual magnetism maintaining contact between the two even after the current in the coil 116 had been reduced to zero. The shim 147 is a few thousandths of an inch thick.

By using the laminated magnetic core structure 117 which provides reduced eddy current losses, the magnetic flux builds up faster and the armature assembly 112 is attracted to the magnetic structure 117 sooner and moves with higher velocity. The faster actuation and increased velocity of the armature assembly 112 transmits increased velocity to the striker 104, thereby imparting greater energy to the gong 103 and producing a louder noise. Or, as already mentioned, the striker 104 may be reduced in mass and still caused to produce the same sound output level as a heavier striker because of the increased velocity. That is, the energy of the striker is equal to $\frac{1}{2}mv^2$, and if the velocity is increased, the mass may be reduced and still produce the same energy output. If the mass of the armature or striker is reduced, the inertia of the system is reduced and the armature assembly 112 is thereby enabled to operate at increased velocity.

Considering now more specifically FIG. 9, there will be seen a line pair comprising wires 148 and 149 which are terminated at the right by a resistor 150. Bridged across the line pair 148 and 149 are various versions of the alarm device described hereinabove. In each device, the elements which may be indicated by electrical symbolism are given numbers which correspond with those used hereinabove. However, in addition, a suffix letter is used to distinguish the various versions. Considering now more specifically, the first device illustrated at the left, bridged across the line pairs 148 and 149, there will be seen a diode 138A, the coil 116A and the connecting wires 135A and 136A. If an a.c. potential is applied across the line pair 148 and 149, current will be able to pass through the coil 116A when line 148 is positive with respect to line 149. During the other portion of the a.c. cycle, the diode 138A will block current flow and allow the armature to restore to its at rest position.

It should be understood that in a practical system all the alarm devices bridged across a given line should be identical and that in this illustration various devices are shown for illustrative purposes only.

Considering now the device with C suffixes, it will be seen that it is designed for d.c. operation and that in response to a flow of current through the coil 116C, the interrupter contacts 141C will be opened, as explained hereinabove in connection with FIG. 5.

Considering again the device with the A suffix designations, the diode 138A provides an additional capability and convenience. The integrity of the line pair 148 and 149 is essential to the operation of the alarm system. Accordingly, it is desirable to be able to perform a test to determine the integrity and continuity of the line pair 148 and 149. The use of the diode 138 provides a convenient and simple means for doing this. More specifically, if a positive and negative d.c. potential is applied to wires 149 and 148, respectively, the diode 138A will block the flow of current through the coil 116A. If all the alarm devices bridged across the line pair 148 and 149 have similarly poled diodes, current can only flow through the line 149, resistor 150 and return on line 148. Thus the use of the diode 138A and the resistor 150 provides a means for supervising the line loop.

In addition to supervising the line loop, it is desirable to be able to determine if one of the alarm devices is missing. Occasionally, such alarm devices are inadvertently or mischievously disconnected. If the alarm device were connected in the manner shown at the left hand end of the wire pair 148 and 149, there would be no means for detecting that the alarm device is missing. However, by providing a pair of wires 136B and 137B from the lower end of the coil 116B it is possible to make the continuity of the wire 149 go through the connection to the alarm device and, therefore, removal of the alarm device would open the line wire 149 and provide an indication of an open loop when the aforementioned supervisory test of the loop is made. Similar connections for detecting a missing d.c. alarm device is shown at the right of the line pair 148 and 149.

In summary, the first alarm device shown in FIG. 9 provides diode 138A for a.c. operation and to permit loop supervision. The second device shown in FIG. 9 provides a diode 138B for the same purposes as that described with respect to 138A and also provides the wires 136B and 137B to provide for missing device supervision. The device illustrated with the C suffix designation is a simple d.c. alarm device and does not permit either loop supervision or missing device supervision. The last device shown with the D suffixes is a d.c. alarm device having a diode 138D which provides for loop supervision and includes leads 136D and 137D to permit missing device supervision.

It will be apparent that various structural changes could be made in the devices without departing from the spirit of this invention. For example, instead of using round gongs 103, other shapes, or tubes, could be used. Also, instead of providing a reciprocating striker 104, the striker could comprise an extension of the armature assembly 112. In another structure, a reciprocating armature instead of a pivoting armature could be used. Other variations will occur to those skilled in the applicable related arts.

While there has been shown and described what is considered at the present to be the preferred embodiment of the invention, modifications thereto will readily occur to those skilled in the related arts. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. An electro-mechanical sound signalling device comprising in combination:

(a) a generally planar bracket assembly for supporting the components of said signalling device;

(b) a U-shaped ferromagnetic structure having first and second legs supported on said planar bracket so that said first and secnd legs lie in planes parallel to that of said planar bracket;

(c) a coil wound on said first leg for generating magnetic flux in said magnetic structure in response to a flow of current in said coil;

(d) an armature pivotally supported on a hinge pin, which, in turn, is supported on said bracket assembly in a plane parallel to said recited planes;

(e) each of said first and second legs terminating in an individual pole face;

(f) said armature including a portion normally separated from said pole faces a controlled distance for pivotal attraction of said portion of said armature to said pole faces in response to generation of a magnetic flux in said magnetic structure; and (g) a longitudinal and reciprocally movable striker situated proximate and parallel to said second leg and coupled to said armature for reciprocal motion in response to the pivotal movement of said armature.

2. The combination as set forth in claim 1, wherein said striker is coupled to said armature by support means supported by said bracket assembly and which provides for continued longitudinal movement of said striker after said armature has contacted said pole faces.

3. The combination as set forth in claim 2 and including bias means for urging said armature said controlled distance away from contact with said pole faces.

4. The combination as set forth in claim 3, wherein said bias means includes spring means for biasing said striker towards contact with said armature.

5. The combination as set forth in claim 4 and including a pair of normally closed spring contacts supported on said planar bracket and coupled to said armature and wherein said contacts are open circuited in response to the attraction of said armature to said pole faces.

6. The combination as set forth in claim 5, wherein said spring bias means comprises said spring contacts and said spring means.

7. The combination as set forth in claim 3, wherein said magnetic structure is fabricated of laminated parts for minimizing eddy current losses whereby the acceleration of said armature towards said pole faces, in response to a current in said coil, is maximized.

* * * * *